US012104847B1

(12) United States Patent
Hurley et al.

(10) Patent No.: US 12,104,847 B1
(45) Date of Patent: Oct. 1, 2024

(54) CONTAINER SHIPPING PROTECTOR WITH IMPROVED THERMAL REGULATION

(71) Applicant: Western Pulp Products Co., Corvallis, OR (US)

(72) Inventors: Richard B. Hurley, Corvallis, OR (US); Dustin S. Law, Corvallis, OR (US); Tom J. Taylor, Corvallis, OR (US); Robert J. Herbert, Philomath, OR (US); Kaleb M. Stinger, Albany, OR (US)

(73) Assignee: Western Pulp Products Co., Corvallis, OR (US)

( * ) Notice: Subject to any disclaimer, the term of this patent is extended or adjusted under 35 U.S.C. 154(b) by 0 days.

(21) Appl. No.: 18/535,549

(22) Filed: Dec. 11, 2023

Related U.S. Application Data

(60) Provisional application No. 63/524,804, filed on Jul. 3, 2023, provisional application No. 63/462,895, filed on Apr. 28, 2023.

(51) Int. Cl.
*F25D 3/06* (2006.01)
*B65D 1/36* (2006.01)

(52) U.S. Cl.
CPC ..... *F25D 3/06* (2013.01); *B65D 1/36* (2013.01); *F25D 2303/0821* (2013.01); *F25D 2303/0844* (2013.01); *F25D 2331/803* (2013.01)

(58) Field of Classification Search
CPC ..... B65D 81/133; B65D 5/503; B65D 81/18; B65D 1/243; B65D 1/36; B65D 85/321; B65D 85/305; F25D 2303/0821; F25D 2303/0841; F25D 2331/803; F25D 2400/32; F25D 3/08; F25D 3/06; F25D 2303/0844; F25D 25/028; F25D 25/021; F25D 2331/812; F25D 2303/0843
See application file for complete search history.

(56) References Cited

U.S. PATENT DOCUMENTS

| | | | | |
|---|---|---|---|---|
| 2,393,245 | A | 1/1946 | Hadsell | |
| 5,335,770 | A * | 8/1994 | Baker | B65D 43/162 229/407 |
| 6,598,419 | B1 | 6/2003 | Tago | |
| 6,820,743 | B2 | 11/2004 | Hurley et al. | |
| 7,097,034 | B2 | 8/2006 | Woog | |
| 7,584,852 | B2 | 9/2009 | O'Brien et al. | |
| 7,743,626 | B2 | 6/2010 | Buckingham | |
| 8,844,718 | B2 | 9/2014 | Hall | |

(Continued)

FOREIGN PATENT DOCUMENTS

WO 1994003377 A1 2/1994

OTHER PUBLICATIONS

Wineshipping LLC, "Wineshipping's Proprietary, Year-Round, Temperature-Controlled Shipping Solution", Unknown publication date, possibly 2020.

(Continued)

*Primary Examiner* — Cassey D Bauer
(74) *Attorney, Agent, or Firm* — patenttm.us

(57) ABSTRACT

A shipping protector for bottles and the like has a coolant receiving bay defined therein, adapted to allow placement of cooling elements therein when the protector is in a shipping carton. The bay is open to the top and bottom such that the cooling element can be inserted therein in a separate operation from the packing of the bottles or the like.

18 Claims, 22 Drawing Sheets

(56) References Cited

U.S. PATENT DOCUMENTS

| | | | |
|---|---|---|---|
| 10,533,789 | B2 | 1/2020 | Allen |
| 10,597,219 | B2 | 3/2020 | Jobe |
| 11,104,471 | B2 | 8/2021 | Gilligan et al. |
| 11,215,389 | B2 | 1/2022 | Gosselin |
| 11,261,015 | B2 | 3/2022 | Gilligan et al. |
| 2016/0251132 | A1 | 9/2016 | Peel |
| 2019/0315564 | A1 | 10/2019 | Chung et al. |
| 2019/0329961 | A1 | 10/2019 | Jobe |
| 2021/0354870 | A1 | 11/2021 | Gilligan et al. |

OTHER PUBLICATIONS

A Guide to Shipping Wine in Extreme Weather, Jul. 18, 2019, Bottle Barn, Santa Rosa, California.

Ranpak.com, "Keep It Cool", Coldchain brochure, COLD-BROCH2210-ENG, unknown publication date, possibly Oct. 2022.

Jon Thorsen, Reverse Wine Snob, "Is It Ok to Ship Wine in the Summer? Summer Wine Shipping Guidelines", https://www.reversewinesnob.com/summer-wine-shipping/, Jun. 27, 2021.

Paul Franson, "Successfully Shipping in Warm Weather", Wine Business Monthly, May 2015, https://www.winebusiness.com/wbm/?go=getArticle&dataId=150427.

Insulated Products Corporation, "48-hour Thermal Protection for Wine Shipment to Maintain Below 30° C.", publication date unknown, https://ipcpack.com/pdf/48-hour-thermal-protection.pdf.

Greg Martellotto, "Authoritative Guide for Shipping Wine Online in Extreme Weather", Feb. 3, 2020, https://www.bighammerwines.com/blogs/news/authoritative-guide-for-shipping-wine-online-in-extreme-weather.

* cited by examiner

CONTAINER SHIPPING PROTECTOR WITH IMPROVED THERMAL REGULATION

CROSS-REFERENCE TO RELATED APPLICATIONS

This application claims benefit of and priority to U.S. provisional patent application Ser. No. 63/462,895 filed Apr. 28, 2023, and U.S. provisional patent application Ser. No. 63/524,804 filed Jul. 3, 2023, which are herein incorporated by reference in their entireties.

BACKGROUND

This disclosure relates to protectors for use in shipping of containers, and more particularly to shipping protectors for beverages, such as bottles and the like.

For shipping beverages containers, such as wine, beer, spirits or other in bottles, packaging materials are employed to reduce the likelihood of breakage during shipment. These materials can take the form of protectors that the bottles are placed in or by, inside of a shipment box, for example.

Ideally, these protectors are made of molded fiber, shown for example in U.S. Pat. Nos. 6,820,743 and 11,261,015. In the style of U.S. Pat. No. 6,820,743, the protectors are trays that are placed in a shipping carton and bottles are positioned in a horizontal orientation between layers of trays. These molded fiber (also referred to as molded paper pulp) protectors are more environmentally friendly as compared to Styrofoam protectors.

An issue with shipping wine is temperature. In "heat hold" summer months, Expanded Polystyrene (EPS) foam upright wine shippers have been used as a preferred means to insulate against high temperatures during shipment. But environmental legislation and consumer pushback is making EPS shippers undesirable. Molded fiber and other more environmentally friendly materials have largely replaced EPS in all but the "heat hold" summer months.

To allow shipping during hot weather, a solution is to add cooling packs to the molded fiber shipping container. These might be ice or frozen gel packs.

U.S. Pat. No. 11,261,015, shows a molded fiber shipping protector that receives bottles in a vertical alignment, and places cooling packs in open spaces within the top layer of the protector configuration to allow shipments during hot weather.

Others have placed ice packs on the outside/backside of lay down trays to place ice packs, but these can only be placed on the top and/or bottom of the pack in which space can be limited. Or, by using a larger shipping carton, cooling packs can be added outside of the footprint of the protectors, but then a larger shipping carton would be required to accommodate the additional volume of the cooling packs, increasing shipping costs since carton size is a factor in cost of shipping. The cooling packs in this method are only placed at the top or bottom of the pack in the above examples. Or, others add cooling by sacrificing one or more bottle cavities within the pack to place ice packs therein, rather than a bottle.

But these solution have drawbacks.

US patent published application US2021/0354870A1 shows a horizontal alignment shipping protector, that defines an interior space to receive cooling packs.

These solution add other issues. A shipper (with limited staff) would like to pre-assemble cartons and pack out the wine shipments without sealing the cartons, in the hours or days in advance of shipping, preparing multiple orders in advance of a specific shipping day or time. But the cooling packs need to be added at the last minute prior to sealing the carton on the shipment day/time to ensure maximum utilization of the ice packs useful life, so the orders cannot be pre-assembled. And, if the coolant blocks are only added at the top most layer, the cooling effect is not well distributed throughout the container.

SUMMARY

In accordance with the disclosure, a shipping protector is provided for bottles, employing a coolant receiving channel on one or more sides of the protector, whereby cartons can be fully packed on a flexible time schedule, and cooling packs added at the last minute and the carton sealed for shipment, maximizing effectiveness of the coolant.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

DETAILED DESCRIPTION

The system according to a preferred embodiment of the present disclosure comprises a shipping protector with a coolant receiving space defining channel on at least one external edge thereof.

In accordance with the present disclosure a solution for providing cooling or temperature increase resistance for shipments of containers, such as wine bottles, is obtained by modification of the shipping protector of the style of U.S. Pat. No. 6,820,743, by providing end voids on 2 ends of the shipping protector, such that when protectors are stacked in a carton, a vertical void is present in the shipping container and provides a receiving bay that allows the cooling blocks to be quickly inserted from above, just prior to sealing the carton for shipment.

Figure 1:
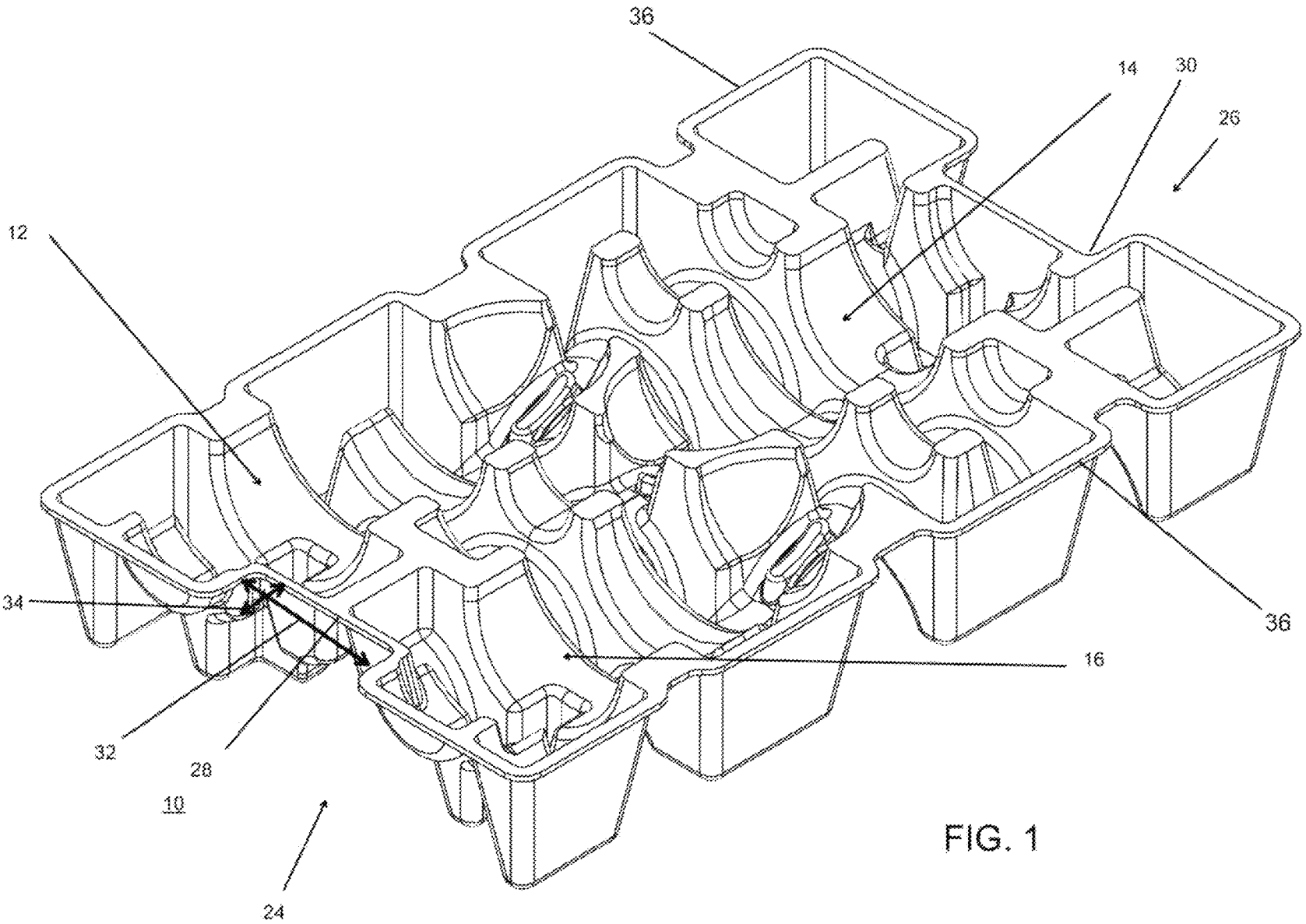
FIG. 1 and FIG. 2 are top and bottom perspective views of a SHIPPING PROTECTOR in accordance with the disclosure.
Figure 2:
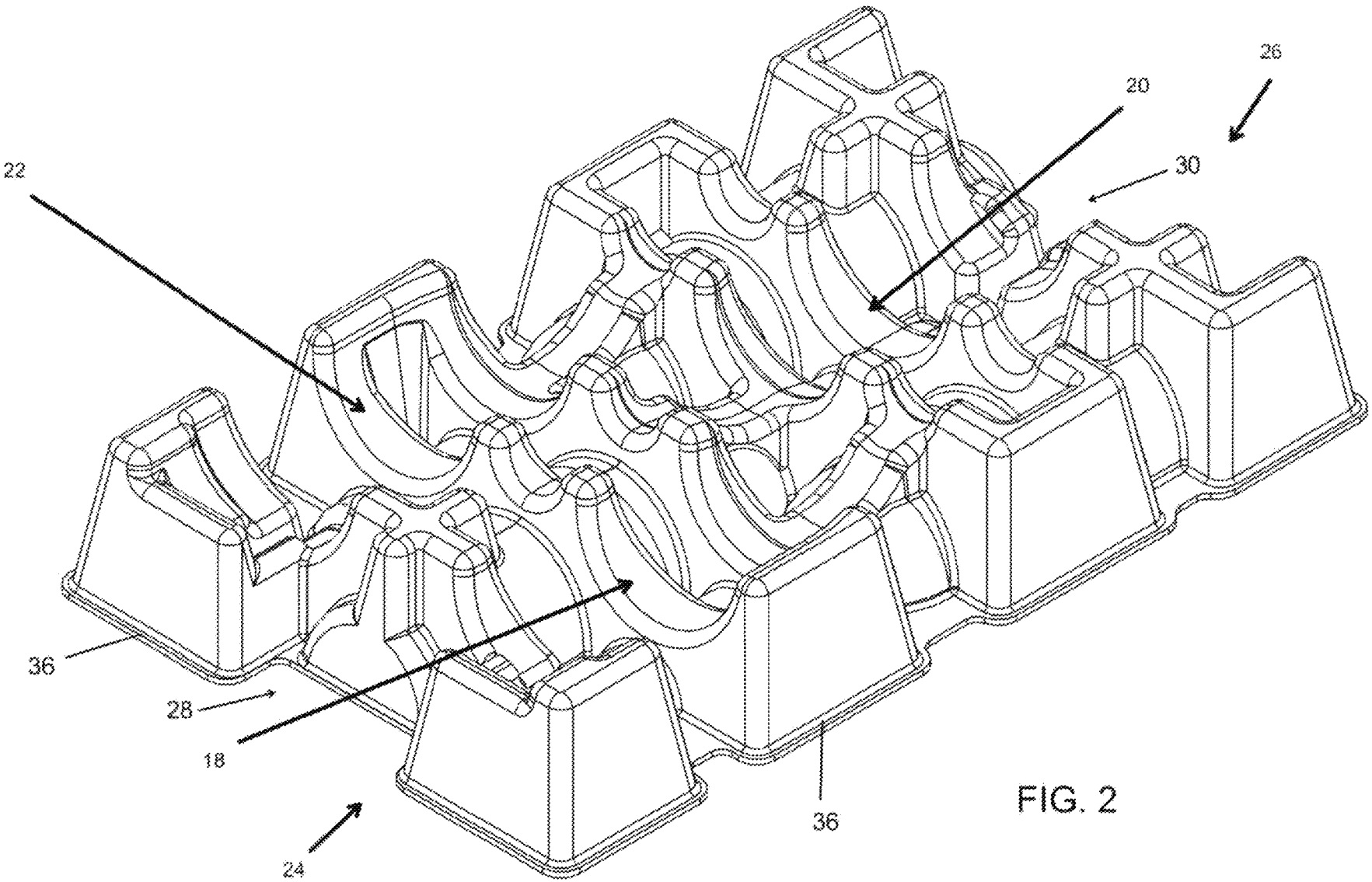
Figure 3:
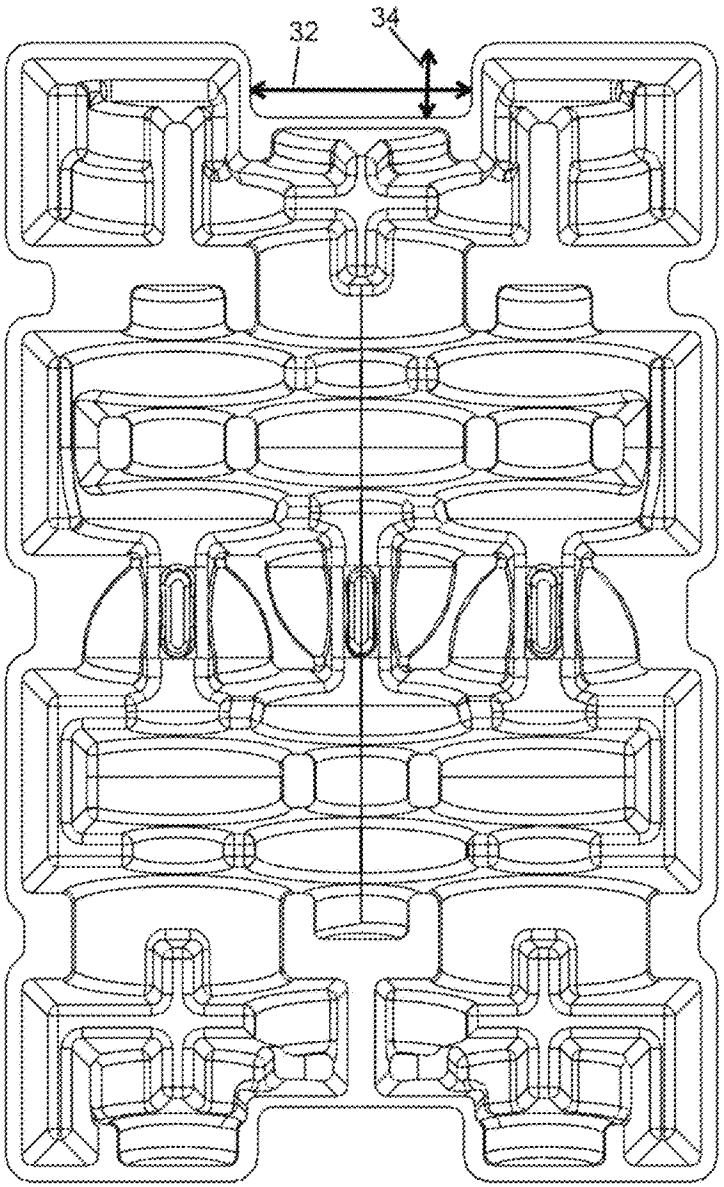
FIG. 3 and FIG. 4 are top and bottom plan views of a SHIPPING PROTECTOR in accordance with the disclosure.
Figure 4:
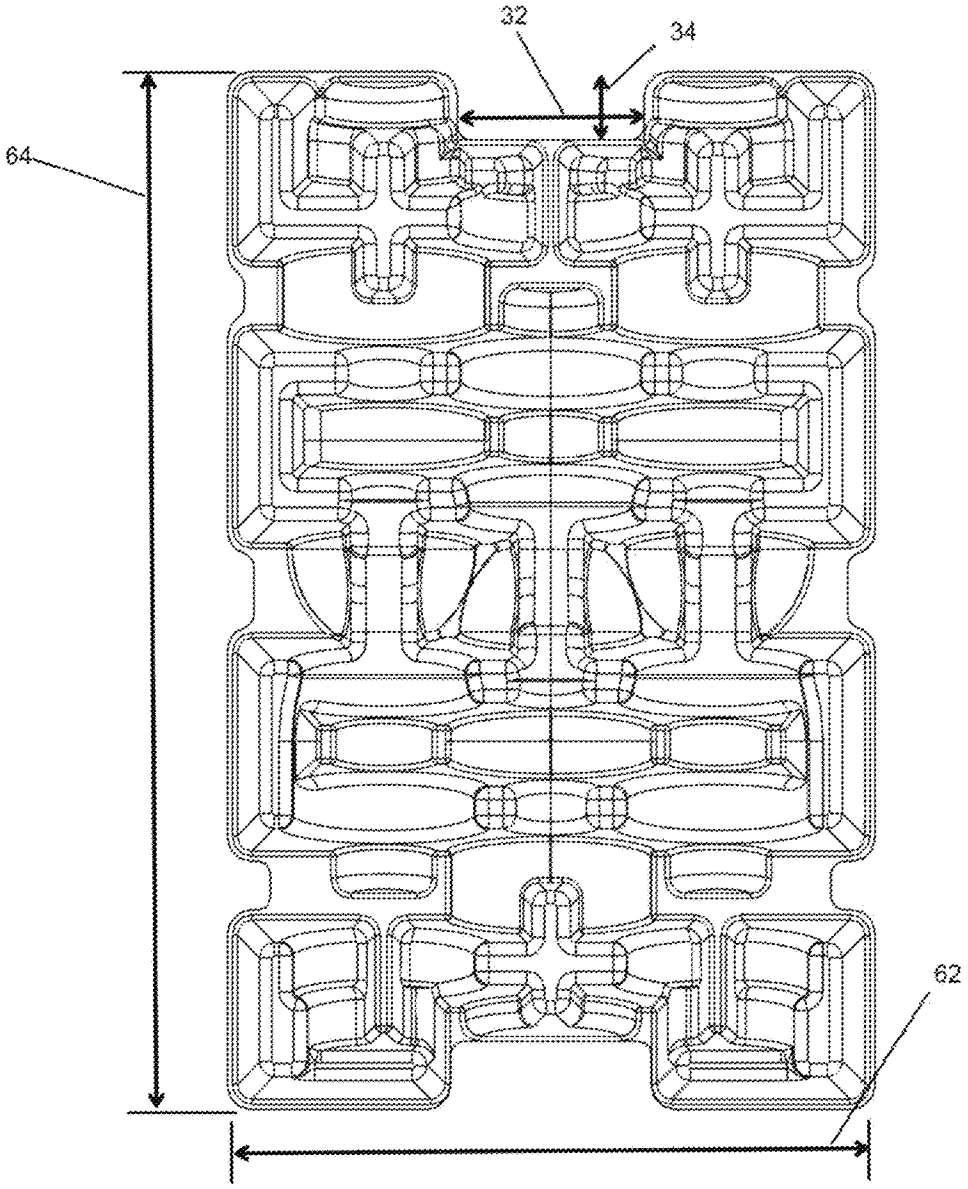

Referring to FIGS. 1 and 2, which are top and bottom perspective views of a shipping protector 10, the protector has multiple bottle receiving bays, for placing containers, such as wine bottles, therein. Two or more protectors are employed and placed within a shipping carton. The protector may be designed with shape and profiles to receive the bottles therein and provide protection against damage during shipment, such as the shipping protectors in U.S. Pat. No. 6,820,743, issued Nov. 23, 2004, entitled SHIPPING PROTECTOR FOR BOTTLES OR THE LIKE, the disclosure of which is incorporated herein by reference.

In the style of U.S. Pat. No. 6,820,743, the protectors are provided as trays that are placed in a shipping carton and bottles are positioned in a horizontal orientation between layers of trays. Molded fiber is the typical, but not only, component of which the trays are formed.

The protector 10 as illustrated has 3 bottle receiving bays 12, 14, 16 formed on one face and 3 bottle receiving bays 18, 20 and 22 formed on the opposite face of the tray. At first and second ends 24 and 26 of the protector, receiving bays 28, 30 are defined in the tray, comprising a substantially rectangular step of the perimeter of the tray towards the tray center, with a step width 32 and depth 34. In a particular embodiment, the receiving bays are approximately 4 inches wide in directions 32, and 1 and ½ inches deep in direction 34. The tray dimensions are approximately 12 inches wide (reference 62) and 19 inches long (reference 64), with a vertical height of 3 inches.

Figure 5:
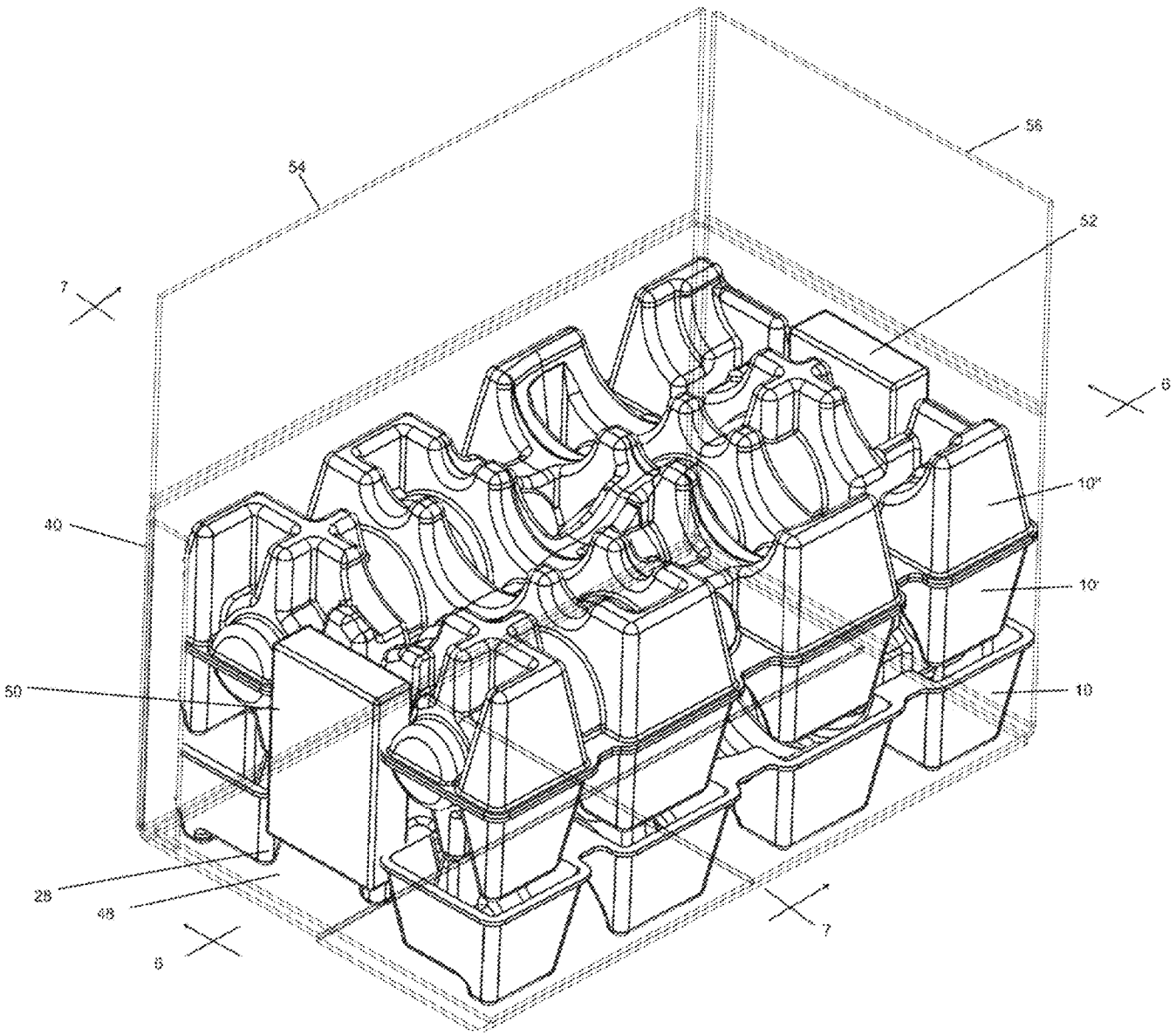
FIG. 5 is a perspective view of a six bottle packaged configuration using the CONTAINER SHIPPING PROTECTOR.

The receiving bays 28, 30, define a space to receive a cooling element therein when packed in a shipping carton. Referring to FIG. 5, a perspective view of a six bottle packaged configuration using the CONTAINER SHIPPING PROTECTOR, three protectors 10, 10', 10". The bottom most protector 10, is placed inside a shipping carton 40 (illustrated with a side and front face of the carton removed, hidden portions of the carton visible behind the stack of protectors). Three bottles 42, 44, 46 are placed in respective bottle receiving bays 12, 14, 16, and then a second protector 10' is positioned on top of protector 10 to align receiving bays 18', 20' and 22' on the bottom of protector 10' with the bottles already in protector 10. Another layer of bottles 42', 44', 46' are then placed in bays 12', 14', 16' of tray 10', and a third protector 10" is then positioned atop the last layer of bottles, an a clamshell relation to protector 10', aligning bays 18", 16" and 12" of protector 10" with the bottles resting in protector 10'.

The receiving bays 28, 28' and 28" on one end of the configuration provide a vertical cooling element receiving shaft 48 and 48' between the stack of protectors and the interior wall of the shipping carton at opposite sides of the carton. Prior to shipment of the package, cooling element 50 may now be placed inside the shaft 48. A further cooling element 52 may be placed in the counterpart cooling element receiving shaft 48' on the opposite side of the protectors, at which point the shipping carton is ready to be sealed by closing the lid flaps 54, 54', 56 and 56'. The lid flaps may now be sealed shut, for example, by taping, and the container packed with bottles and shipping protectors plus coolant is ready for shipment.

Figure 6:
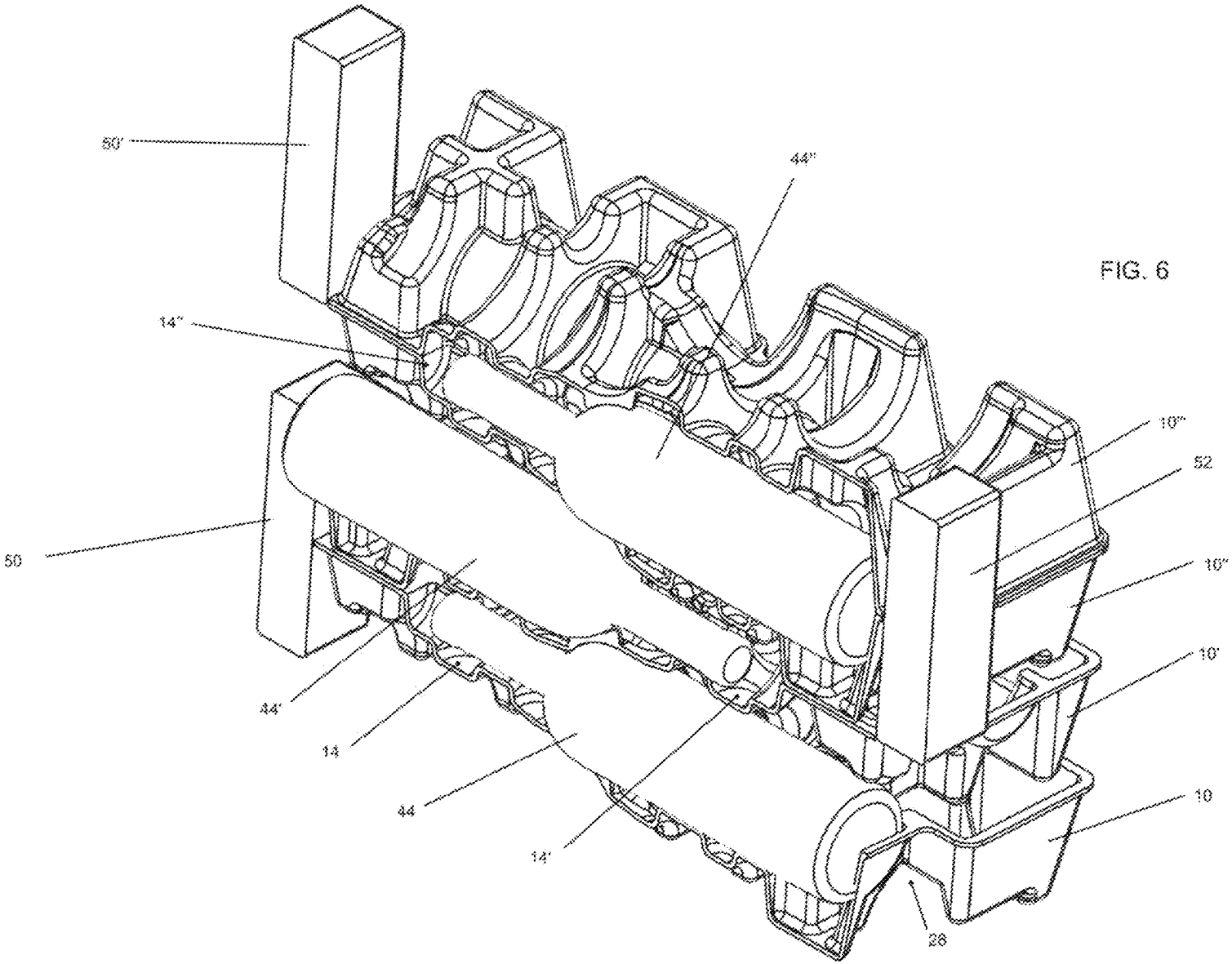
FIG. 6 is a sectional view of a nine bottle packaged configuration as would be taken along line 6-6 of FIG. 5.

FIG. 6, a sectional view of a nine bottle shipping configuration, taken through the protectors as if along line 6-6 of FIG. 5, showing bottles 44, 44', and 44" which are in the center bottle receiving bay 14/20' of trays 10/10' and bays 14'/14" of trays 10'/10" and bays 14"/14'" of trays 10"/10'". The placement of the cooling elements 50, 50', 52 in the shafts 48, 48' defined by shipping carton 40 (removed in this view for ease of illustration) and the receiving bays 28, 28' and 28" may be observed. In FIG. 6, an additional cooling element 52' is yet to be inserted.

Figure 7:
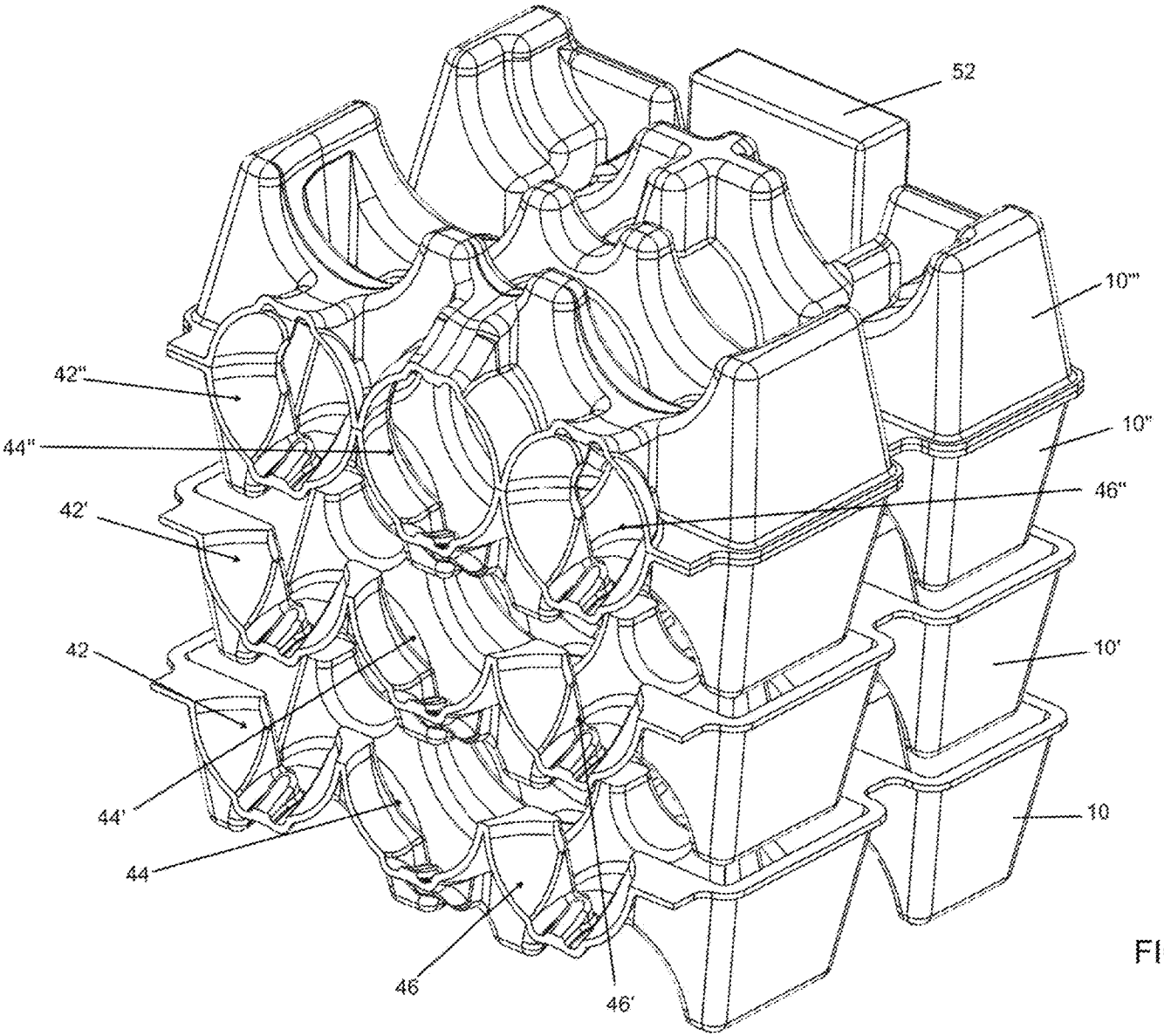
FIG. 7 is a sectional view of a nine bottle packaged configuration with the box removed as would be taken along line 7-7 of FIG. 5

FIG. 7 is a sectional view of the nine bottle shipping configuration of FIG. 6, taken through the protectors as if along line 7-7 of FIG. 5, with the bottles removed illustrating the placement of locations where bottles 42, 44 and 46 would be between in bays 14, 16 and 18 between trays 10, 10' and bottles 42', 44' and 46' between trays 10' and 10" and bottles 42", 44" and 46" between trays 10" and 10'".

Figure 8:
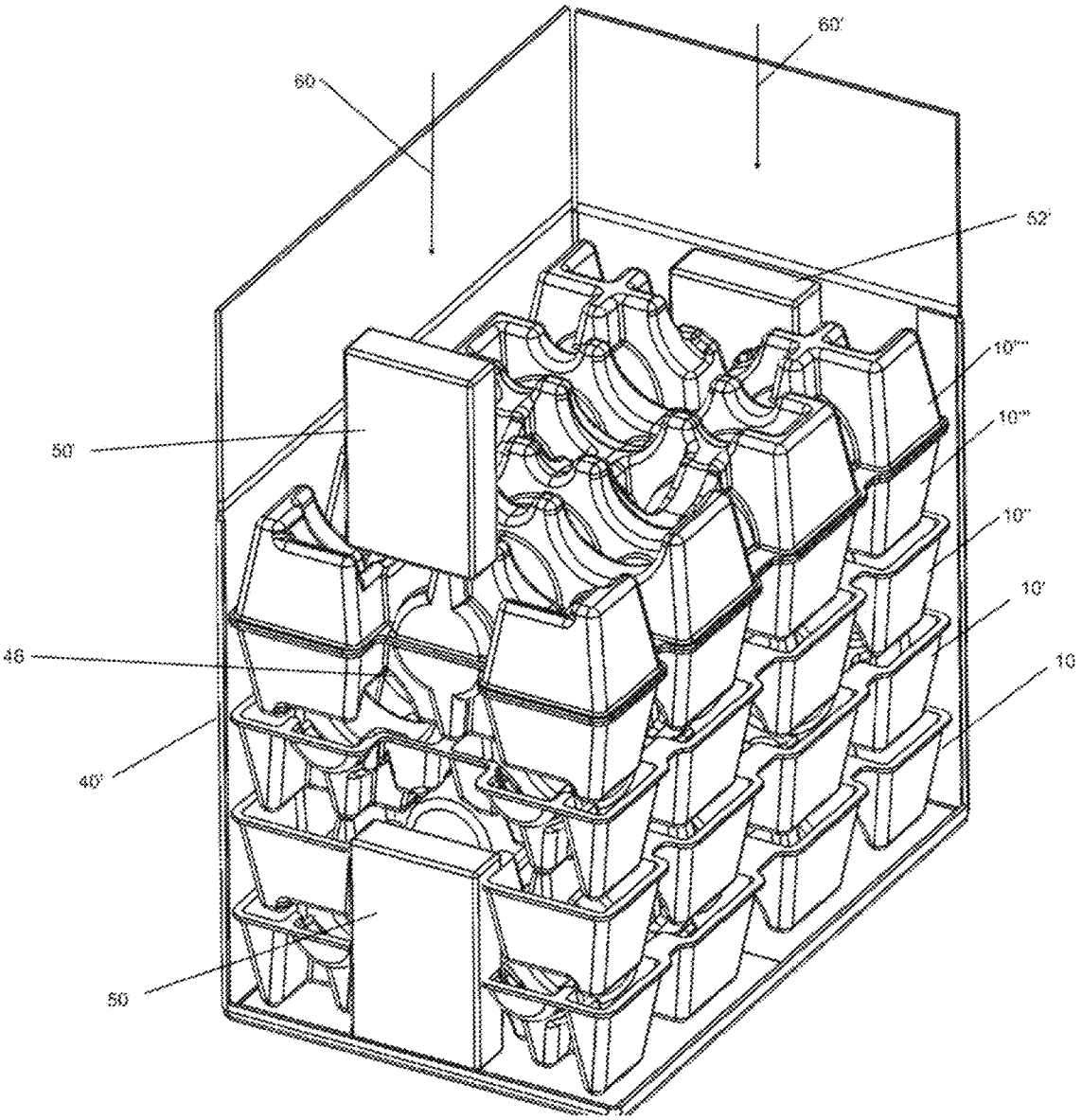
FIG. 8 is a perspective view of the SHIPPING PROTECTOR employed in a twelve bottle packing configuration, in the process of receiving the cooling elements.
Figure 9:
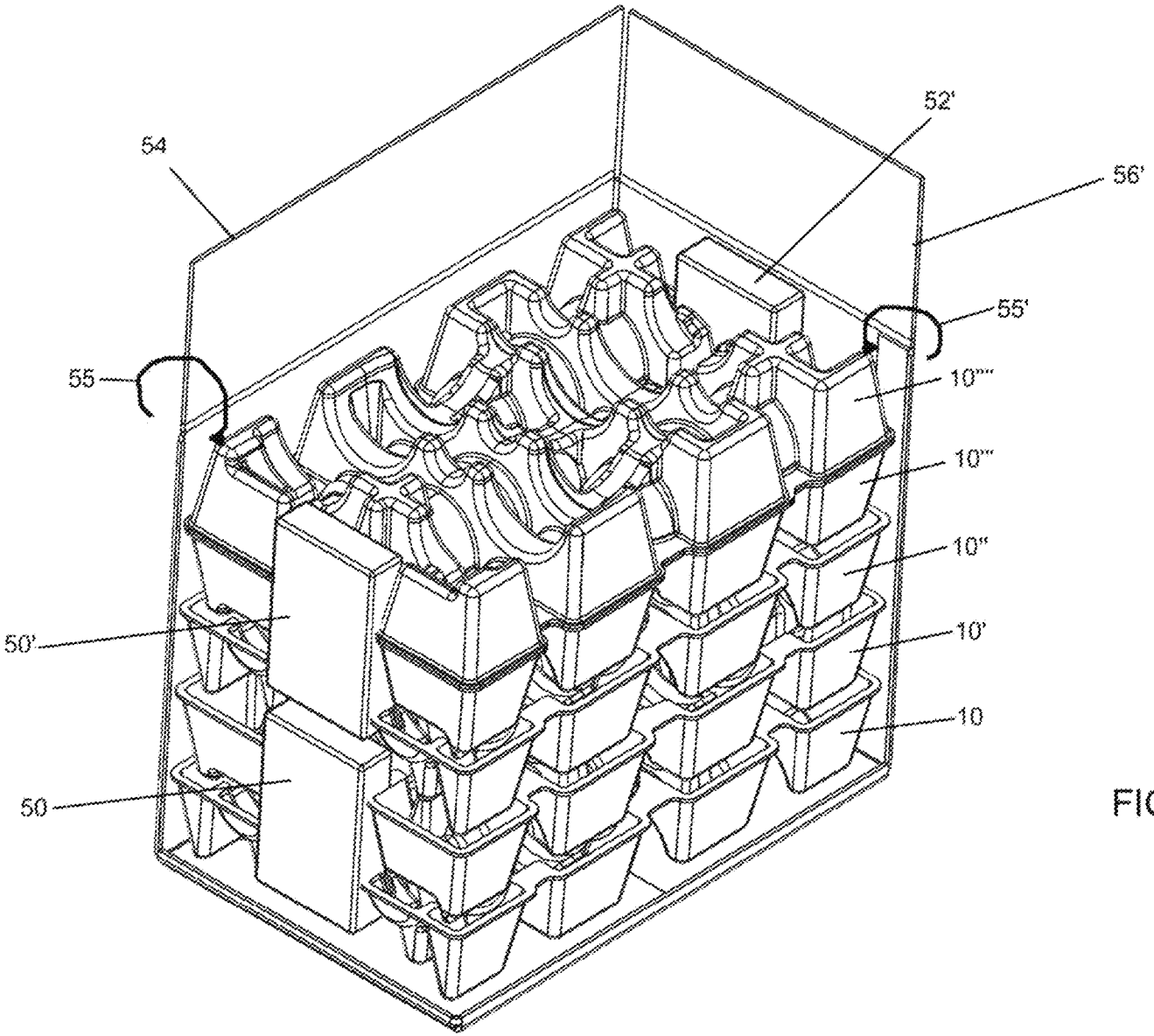
FIG. 9 is a view of a shipping carton packed with bottles using the SHIPPING PROTECTOR with all cooling elements installed, ready to close and ship.

While the illustration of FIG. 5 shows a six bottle shipping configuration, other configurations may be employed, such as three bottles, using two trays 10, nine bottles, using four trays 10, and twelve bottles, using five trays, as in FIGS. 8 and 9.

Referring to FIG. 8, a perspective view of the SHIPPING PROTECTOR employed in a twelve bottle packing configuration, in the process of receiving the cooling elements, after all of the trays 10, 10', 10", 10'" and 10"" are packed with wine bottles and placed into the carton 40' (a front and side face of the container removed for ease of illustration), the cooling elements can now be lowered into the cooling element receiving shafts 48, 48', by positioning the cooling elements above the top of the shafts and lowering them into the shafts in the directions of arrows 60, 60'.

FIG. 9 is a view of a shipping carton packed with bottles using the SHIPPING PROTECTOR with all cooling elements installed, ready to close and ship, with 2 sides of the carton removed for illustration. If even additional cooling is desired, additional cooling elements can be added in the spaces of the top tray layer before closing the box. The carton lid flaps 56, 56' and 54, 54' may then be closed by folding the flaps as noted by the arrows 55, 55', and the carton sealed and moved on to ship.

Figure 16:
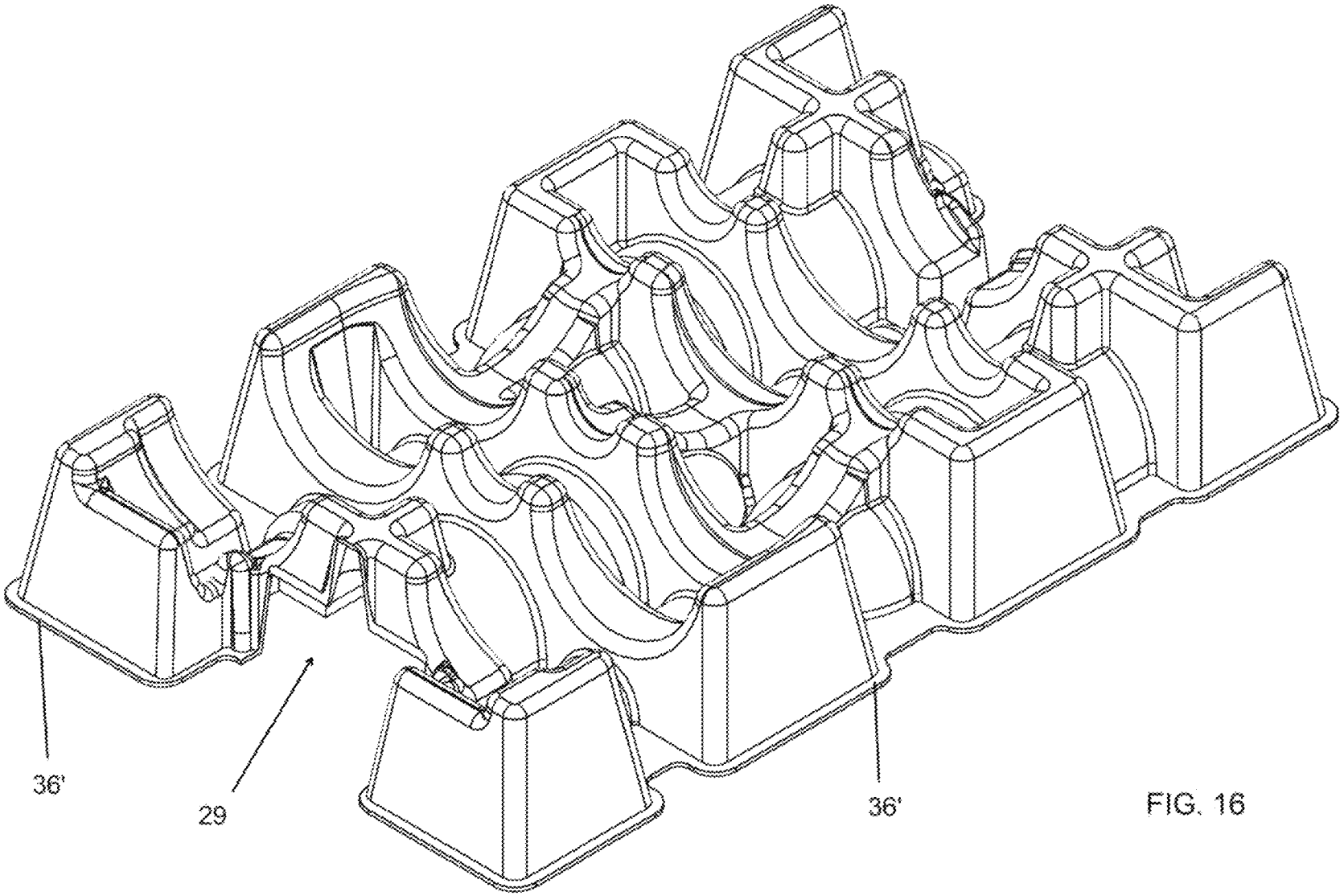
FIGS. 16 and 17 are first and second end perspective views of a 3/6/9/12 bottle configuration tray with alternative coolant receiving bay configurations.
Figure 17:
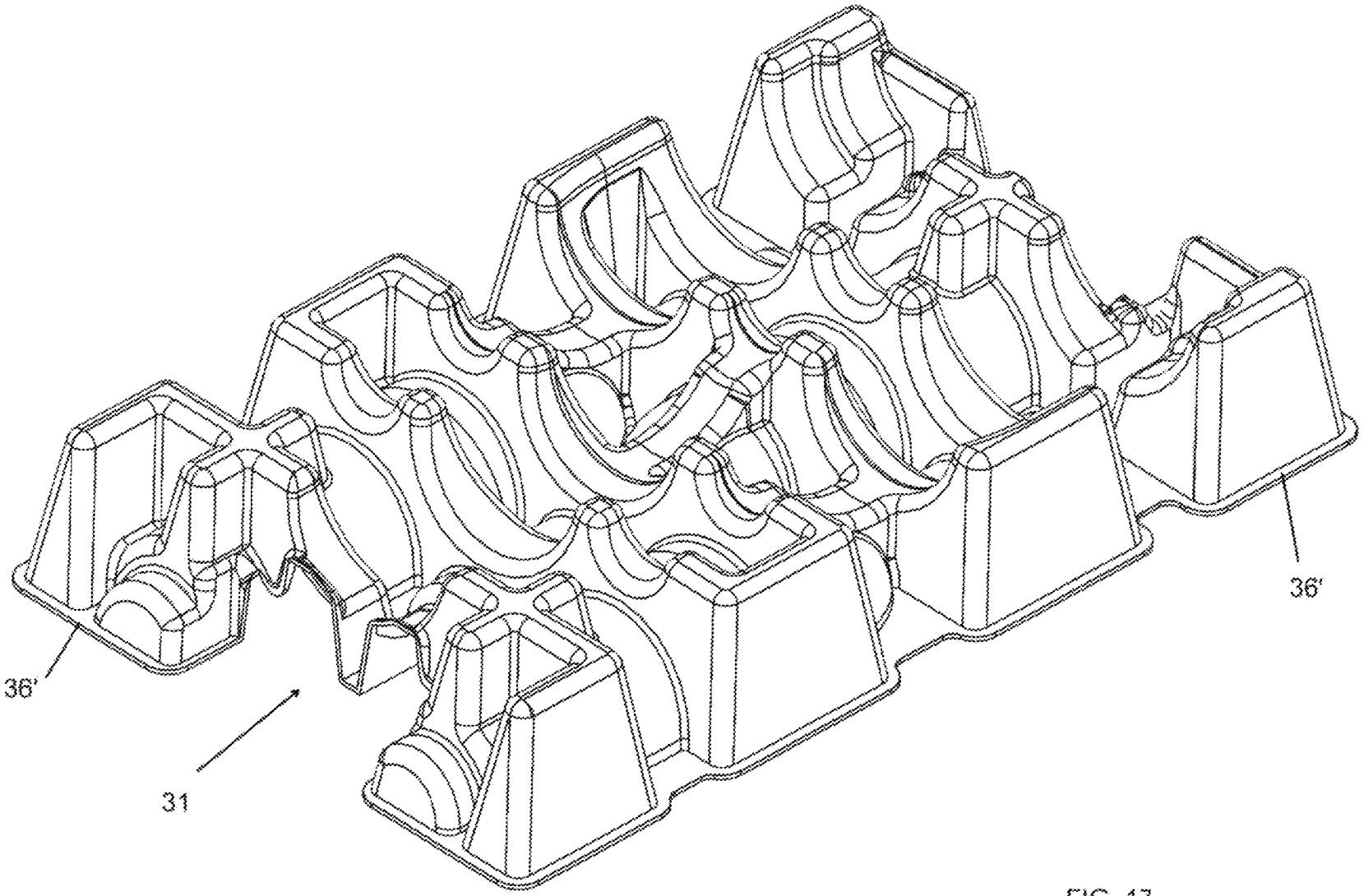

The SHIPPING PROTECTOR as illustrated in FIGS. 1 and 2 has a peripheral rim lip 36 that extends substantially the entire perimeter of the protector. In an alternative embodiment, the rim lip may be absent partially along portions of the coolant receiving bay (s). Referring to FIGS. 16 and 17, first and second end perspective views of a 3/6/9/12 bottle configuration tray with alternative coolant receiving bay configurations, in this embodiment, the peripheral rim lip 36' is present along most of the periphery of the protector, but the lateral faces of the receiving bays 29, 31 are formed without the rim lip.

It is not necessary to fill all of the bottle receiving bays, so one or more layers in the shipping container can be shipped with fewer than 3 bottles. In use, typically the top most tray is inverted in orientation relative to the trays below, forming a clam shell like top most layer. The size of the carton 40 used is selected to contain the number of trays employed. If further cooling capacity is desired, empty bays may have further cooling elements place therein.

Figure 10:
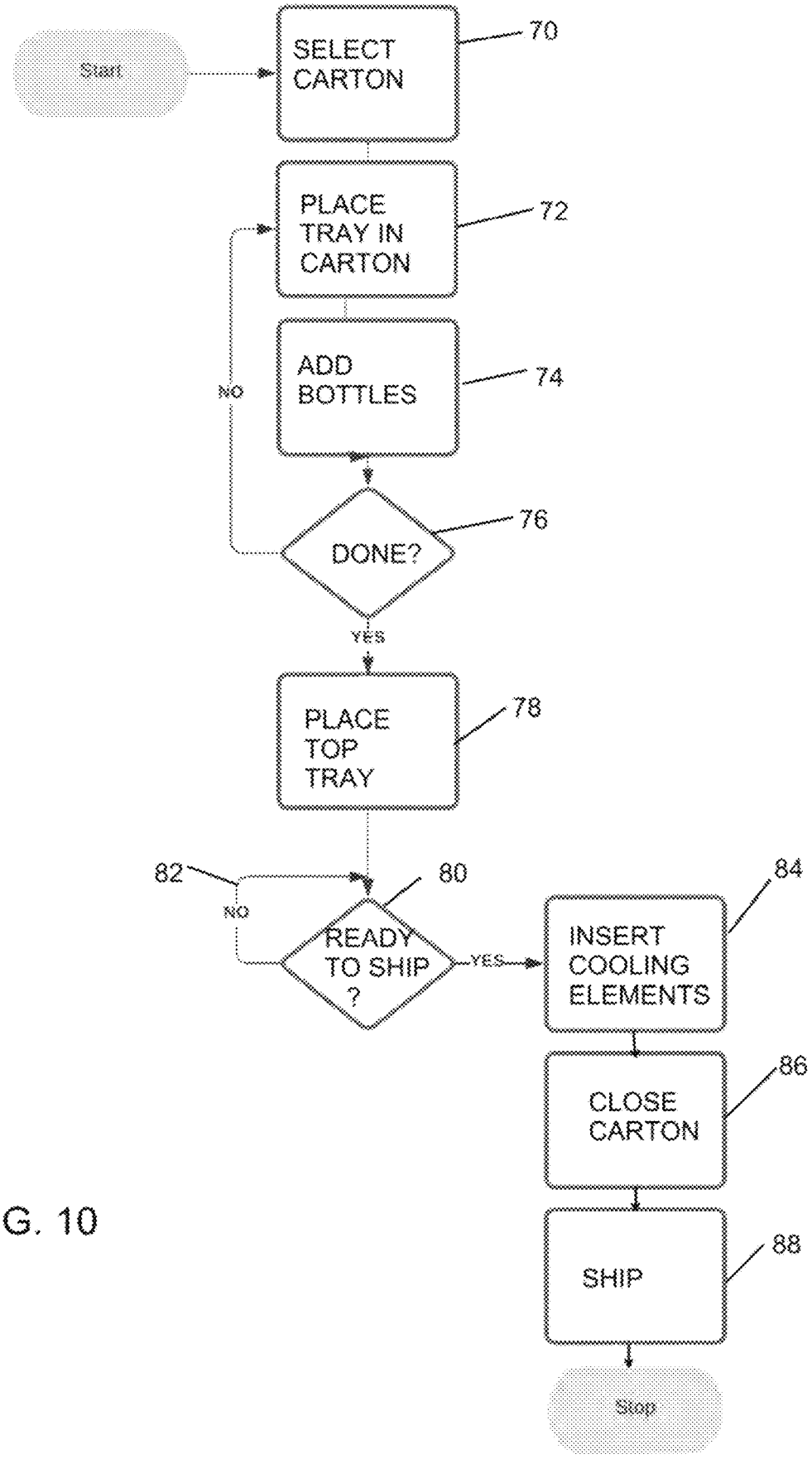
FIG. 10 is a flow chart of the process of packing a shipment using the SHIPPING PROTECTOR.

A method of preparing for shipment using the tray of the invention is shown in the flow chart of FIG. 10. In the example of FIG. 10, the containers being shipped are wine bottles.

The process begins at step 70, wherein a shipping carton is selected having an appropriate size depending on the number of wine bottles being shipped. Next, in step 72, a shipping protector is placed in the bottom of the carton, and wine bottles are placed into the protector (step 74). Because the typical molded fiber shipping protector is two sided in its design the orientation or placement of the tray in the carton can vary. Then it is determined whether or not the desired number of bottles have been packed in the carton at decision block 76. If not, processing continues at step 72, to place another shipping protector into the carton, on top of the protector layer having the bottles already placed, and continue adding another layer of wine bottles. If at decision block 76 the desired number of bottles has been packed, then a top tray layer is added at step 78, suitably with the tray typically inverted to form a clamshell configuration for the top most layer in the carton.

Now, if not ready to ship at decision block 80, a wait period 82 is entered until such time as shipment is to be completed. The carton may be moved to a storage location to await shipping, with the top closed or not.

Once ready to ship, then at step 84, the cooling elements are inserted into the coolant element receiving shafts 48, 48', with the number of elements added determined by factors such as the cost, expected cooling needed and number of bottles packed in the particular carton. The carton may now be closed (block 86) and sent to ship (block 88).

The shipping protector may be composed of molded fiber, and can be provided with moisture resistance additives to withstand any condensation that may occur from the cooling elements.

The above embodiment of the SHIPPING PROTECTOR is designed for shipping bottles in configurations of multiples of three, 3/6/9/12 bottles in a box. An alternative embodiment is shown in FIGS. 11-15, designed for one or two bottle shipment configurations (or multiples of 1 or 2).

Figure 11:
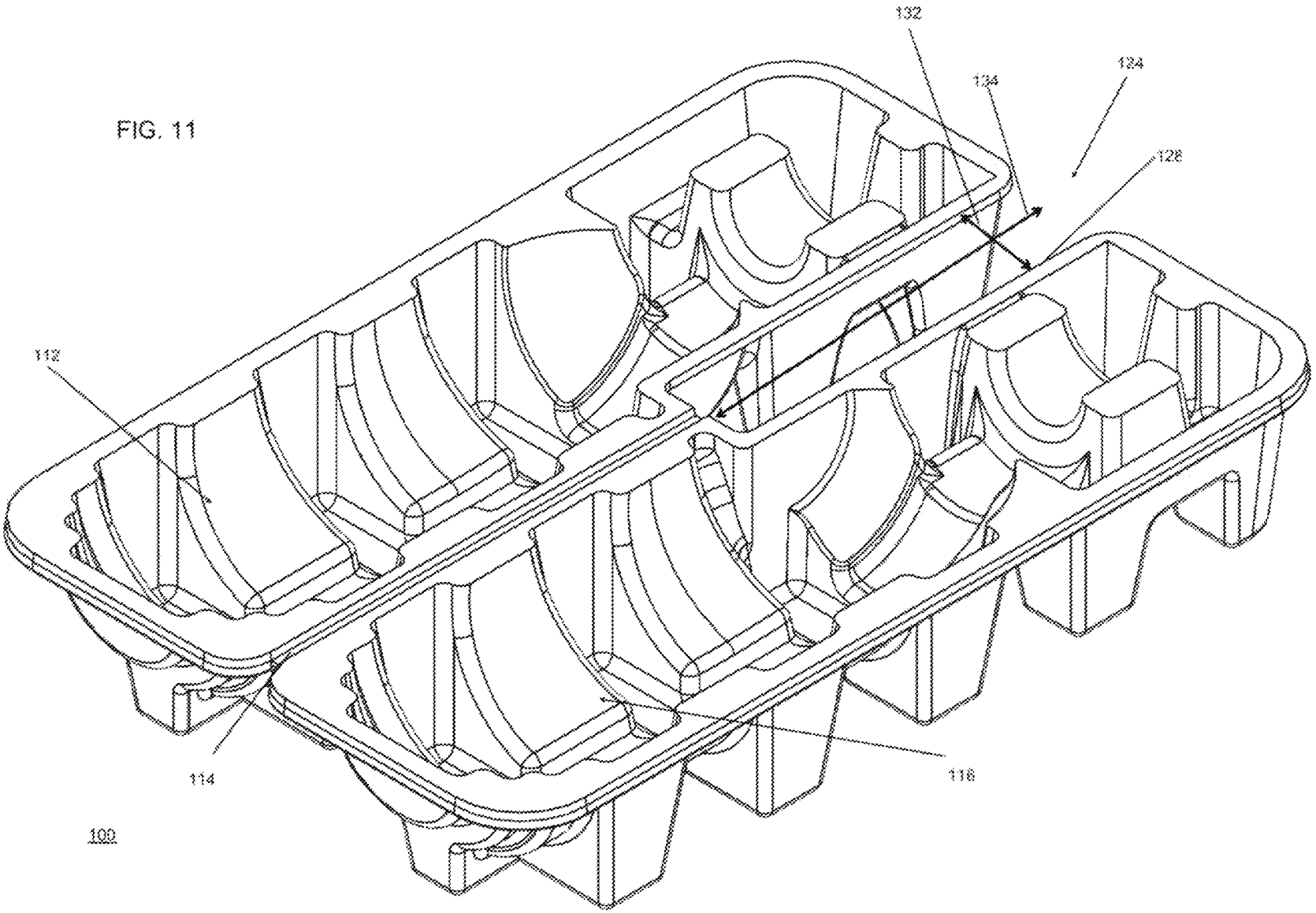
FIGS. 11 and 12 are top and bottom perspective views of a SHIPPING PROTECTOR in accordance with another embodiment.
Figure 12:
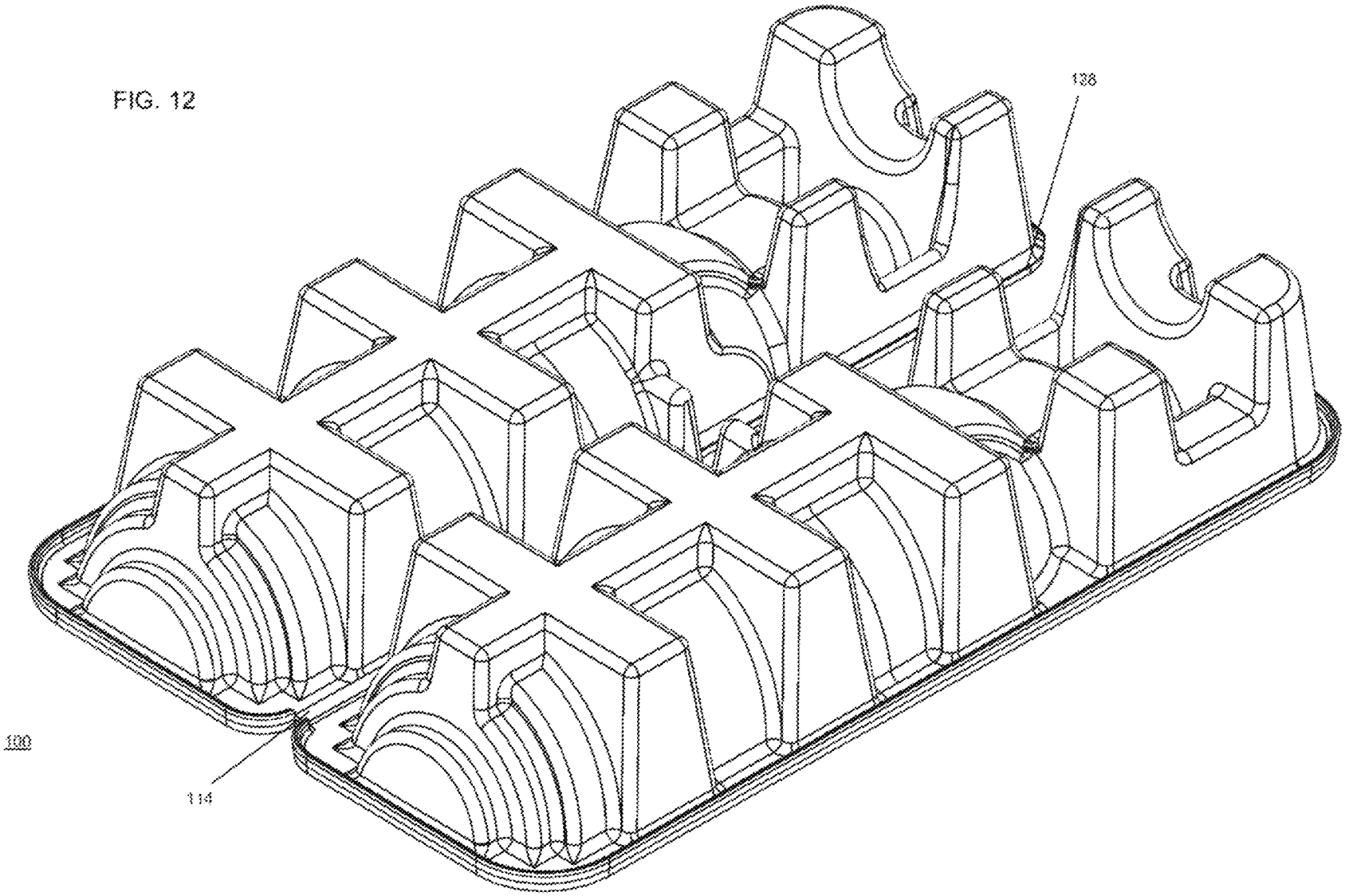

Referring to FIGS. 11 and 12, top and bottom perspective views of the alternative embodiment 1 to 2 bottle (or multiples thereof) SHIPPING PROTECTOR, the shipping protector 110 has two bottle receiving bays, for placing a wine bottle or bottles (or other containers) therein. One or more protectors are employed and placed within a shipping carton. As with the above embodiment, the protector is designed with shape and profiles to receive the bottles therein and provide protection against damage during shipment.

The protector 110 as illustrated has 2 bottle receiving bays 112, 116 formed on one face. A hingeable portion 114 is formed between the two bays along a portion of the length of the protector. At one end 124 of the protector, a receiving bay 128 is defined in the tray, comprising a substantially rectangular step of the perimeter of the tray towards the tray center, with a step width 132 and depth 134. Depth 134 also defines a longitudinal line that aligns with the fold line of the hingeable portion 114. Depth 134 also defines a longitudinal line that aligns with the fold line of the hingeable portion 114.

Figure 13:
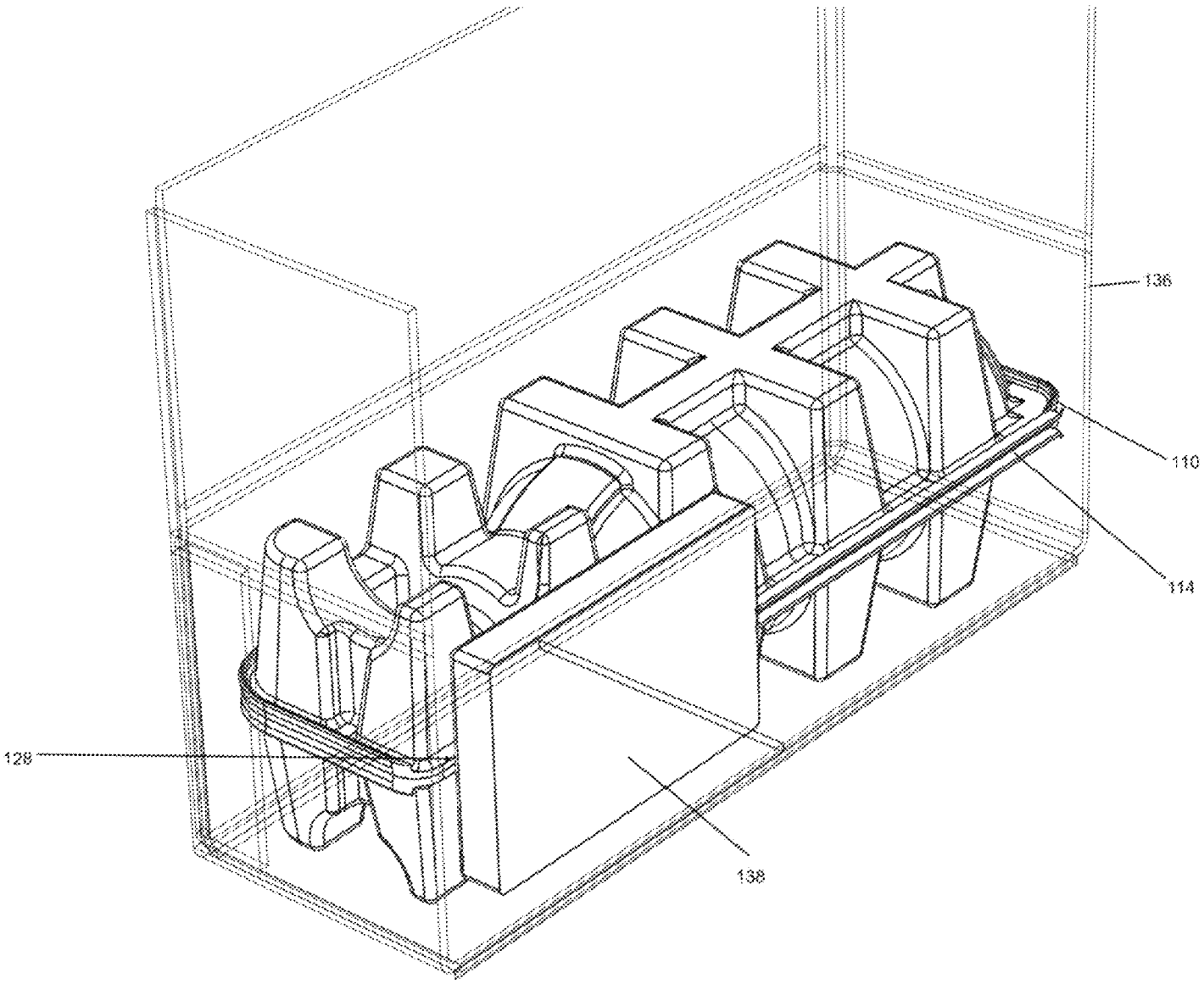
FIG. 13 is a view of single bottle shipping configuration box packed with one of the SHIPPING PROTECTORS of FIGS. 11 and 12 showing the cooling element inserted.

For a single bottle shipping use, with reference to FIG. 13, a bottle is placed in bay 112 (or 116), and the other bay is moved to receive the bottle by folding of the protector along hingeable portion 114, so that the bottle is surrounded by the protector bays 112 and 116. The folded protector and bottle are then placed into a shipping box 136, and when it is time to ship, a cooling element 138 is placed into the space defined by the now folded over receiving bay 128. The box may be closed and a single bottle shipped.

Figure 14:
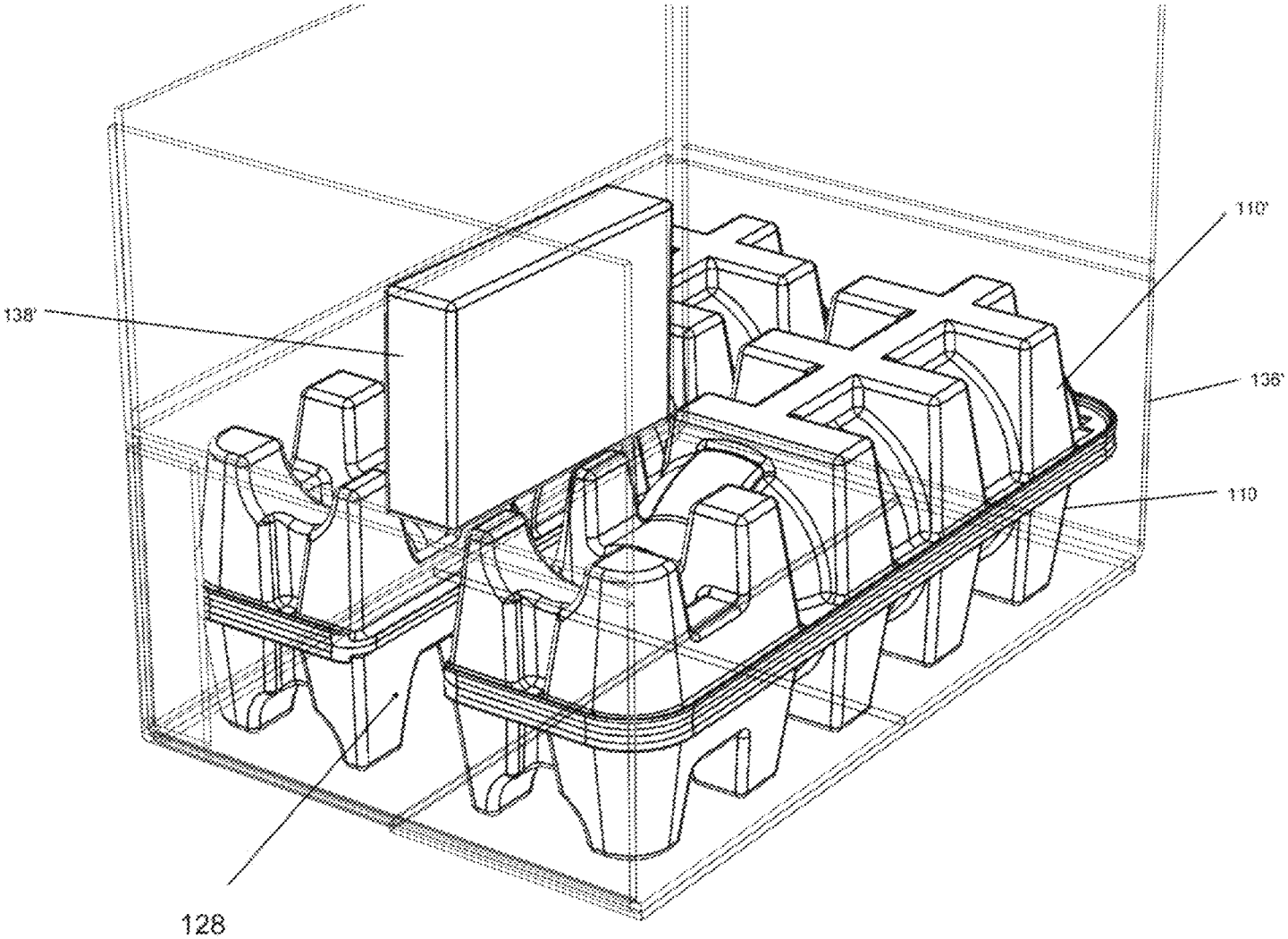
FIG. 14 is a view of a box using SHIPPING PROTECTOR of FIGS. 11 and 12 in a two bottle shipping configuration.

For shipping of two bottles or multiples thereof, reference is made to FIG. 14, where a protector 110 is placed into a box 136' with the receiving bays oriented upward, and bottle is placed in each of bays 112 and 116 of the protector. A second protector 110' is moved into position over the first protector and bottles, with the receiving bays oriented downward. A cooling element 138' may be placed into the space defined by the receiving bays 128 when it is time to ship, and the box may then be closed for shipping. Cooling elements 138 and 138' may be of different dimensions to depending on their fit into the bay 128.

Figure 15:
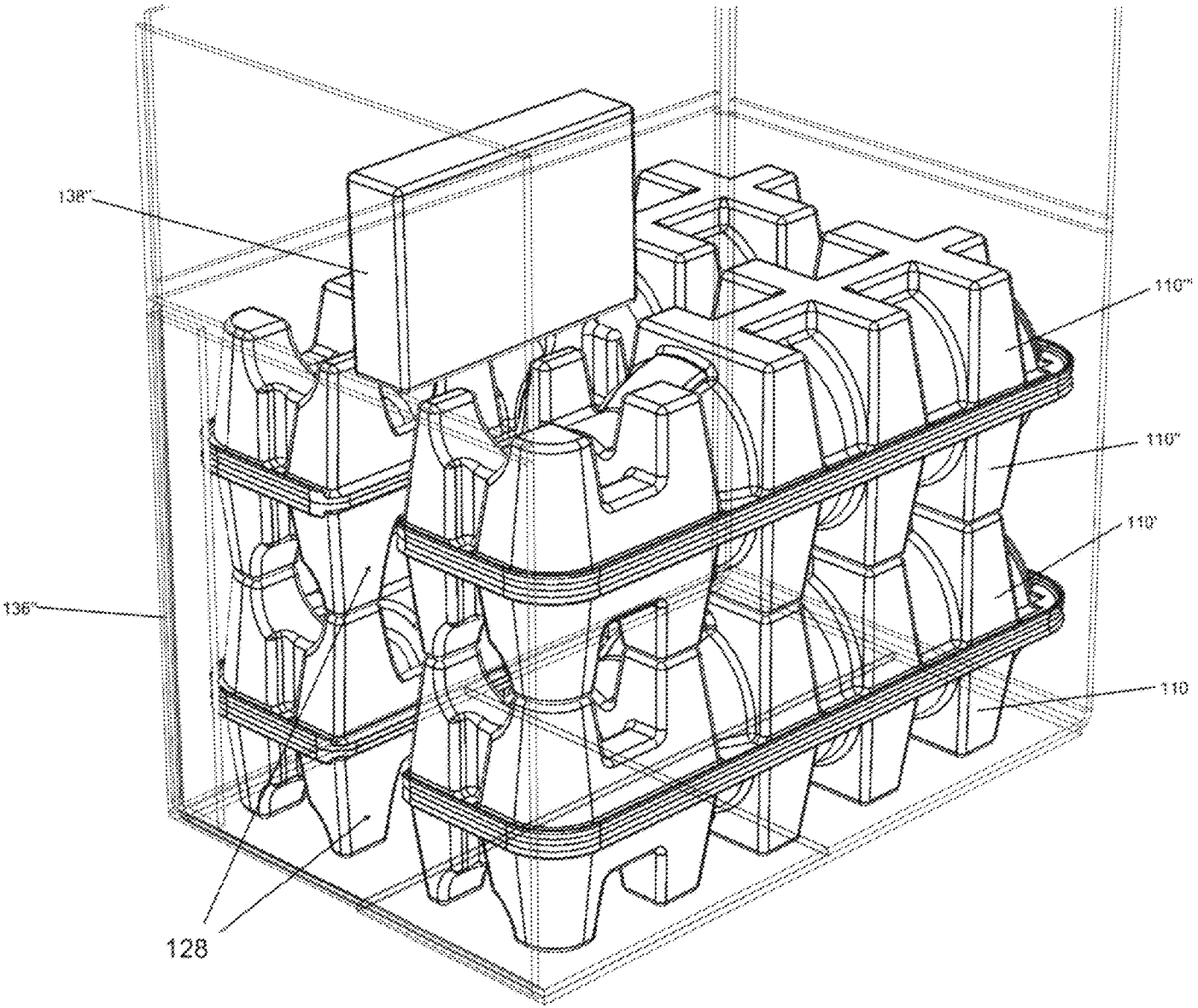
FIG. 15 is a view of a box using SHIPPING PROTECTOR of FIGS. 11 and 12 in a four bottle shipping configuration.

FIG. 15 illustrates use of SHIPPING PROTECTORS of FIGS. 11 and 12 in a four bottle shipping situation. In this situation, as in FIG. 14, a protector 110 is placed into a box 136" with the receiving bays oriented upward, and a bottle is placed in each of bays 112 and 116 of the protector. A second protector 110' is moved into position over the first protector and bottles, with the receiving bays oriented downward. Now, a third SHIPPING PROTECTOR 110" is positioned atop the protector 110', with the receiving bays oriented upward, and a bottle is placed in each of bays 112 and 116 of the protector. A fourth protector 110'" is moved into position over the third protector and bottles, with the receiving bays oriented downward. One or more cooling elements 138" may be placed into the space defined by the receiving bays 128 when it is time to ship, and the box may then be closed for shipping.

FIGS. 18-22 illustrate a further embodiment of a shipping protector 140, wherein portions of the protector wall include cut-away regions 142, 144, indicated in broken lines, at the interior walls of the bottle receiving bays 112, 116. These cut-away regions provide openings, cooling windows, such that when a bottle is placed in the receiving bay 112, 116, a cooling element that is placed against a face of the protector is able to contact substantially directly with a portion of the bottle that is exposed by the cooling window, providing enhanced cooling of the bottle via the more direct contact with the cooling element, without the walls of the protector acting as partial insulation between the cooling element and the bottle.

Figure 18:
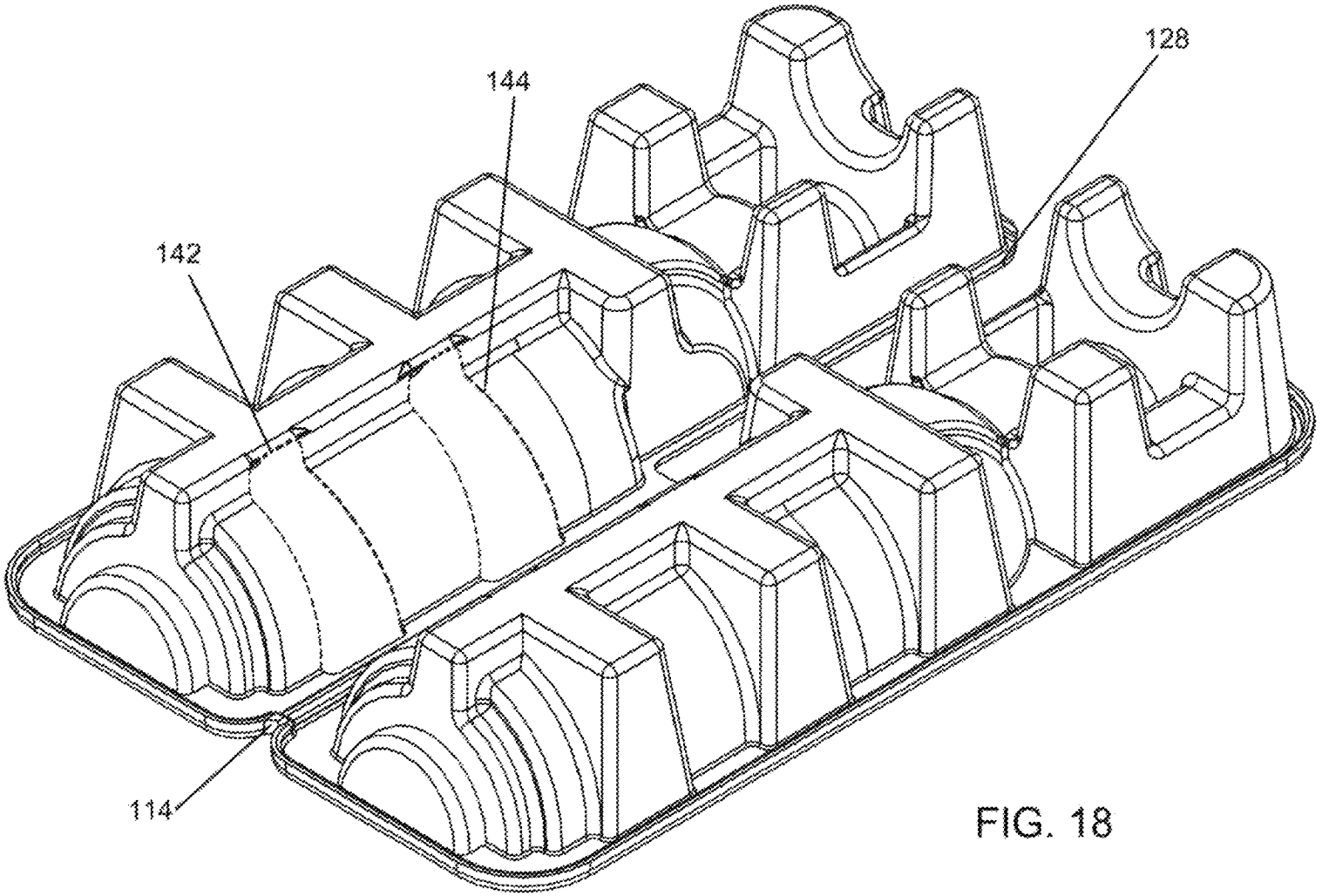
FIG. 18 is a bottom perspective view of a further embodiment of a SHIPPING PROTECTOR.
Figure 19:
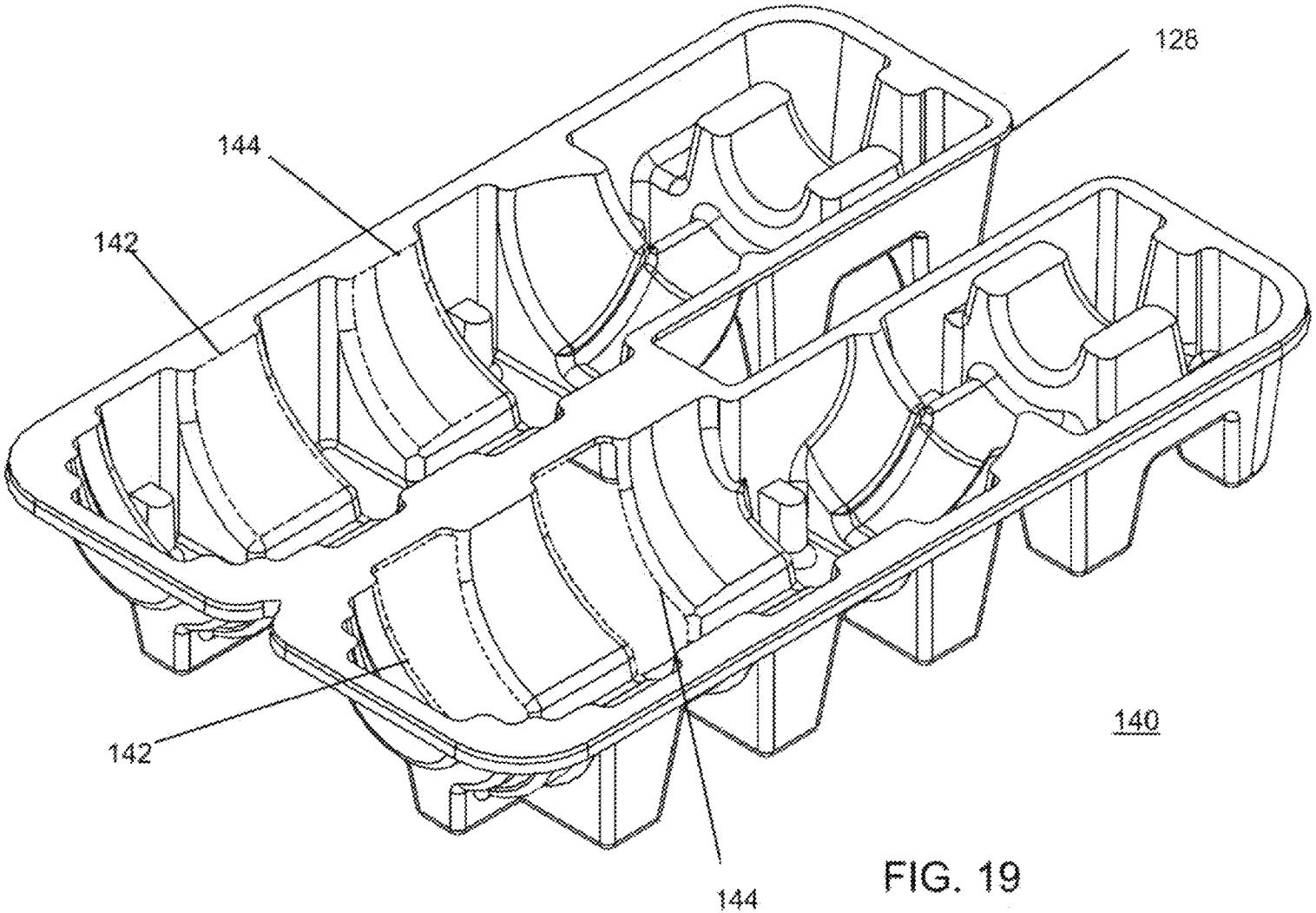
FIG. 19 is a top perspective view of the SHIPPING PROTECTOR of FIG. 18.
Figure 20:
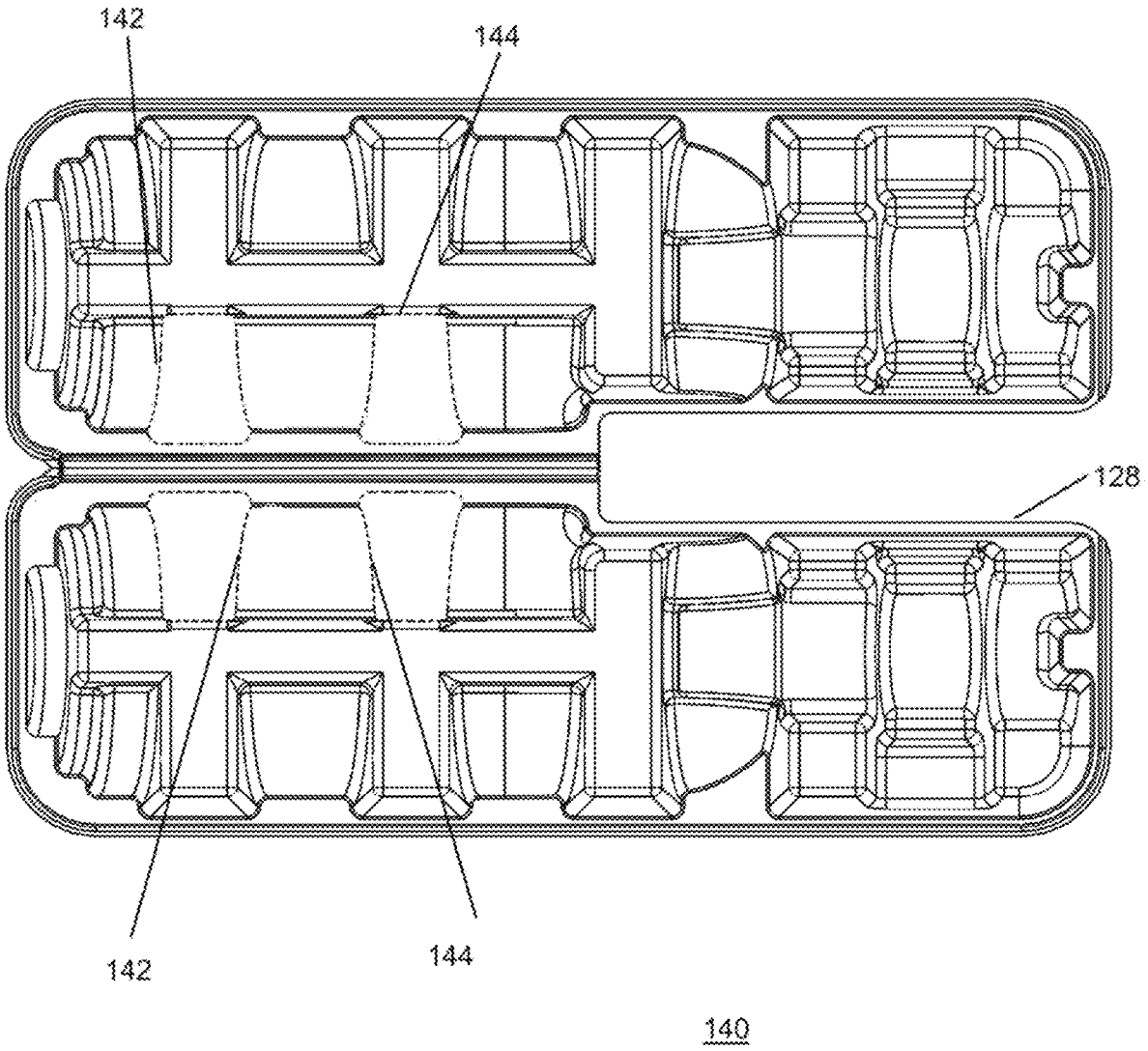
FIG. 20 is a bottom plan view of the SHIPPING PROTECTOR of FIG. 18.
Figure 21:
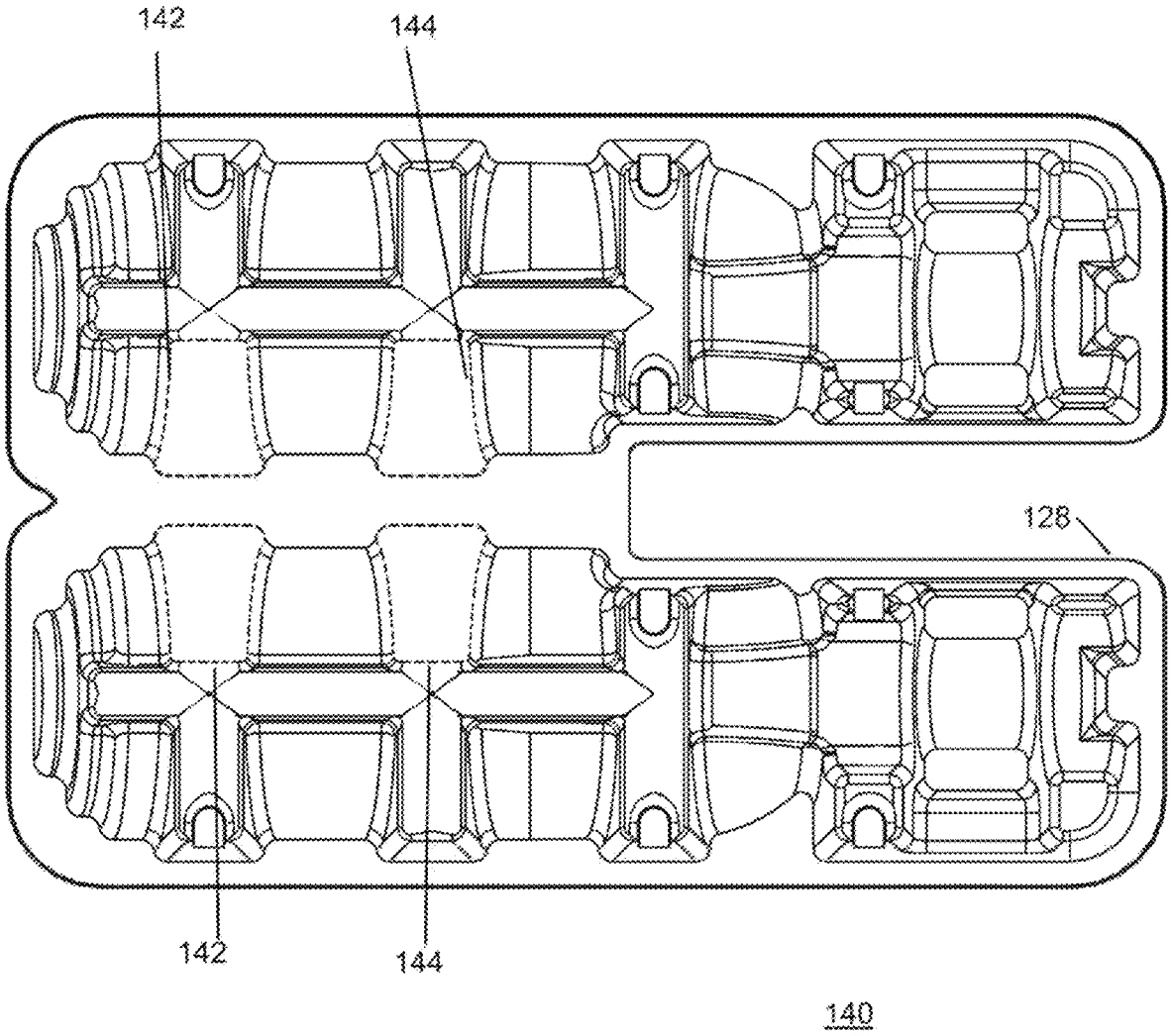
FIG. 21 is a top plan view of the SHIPPING PROTECTOR of FIG. 18.
Figure 22:
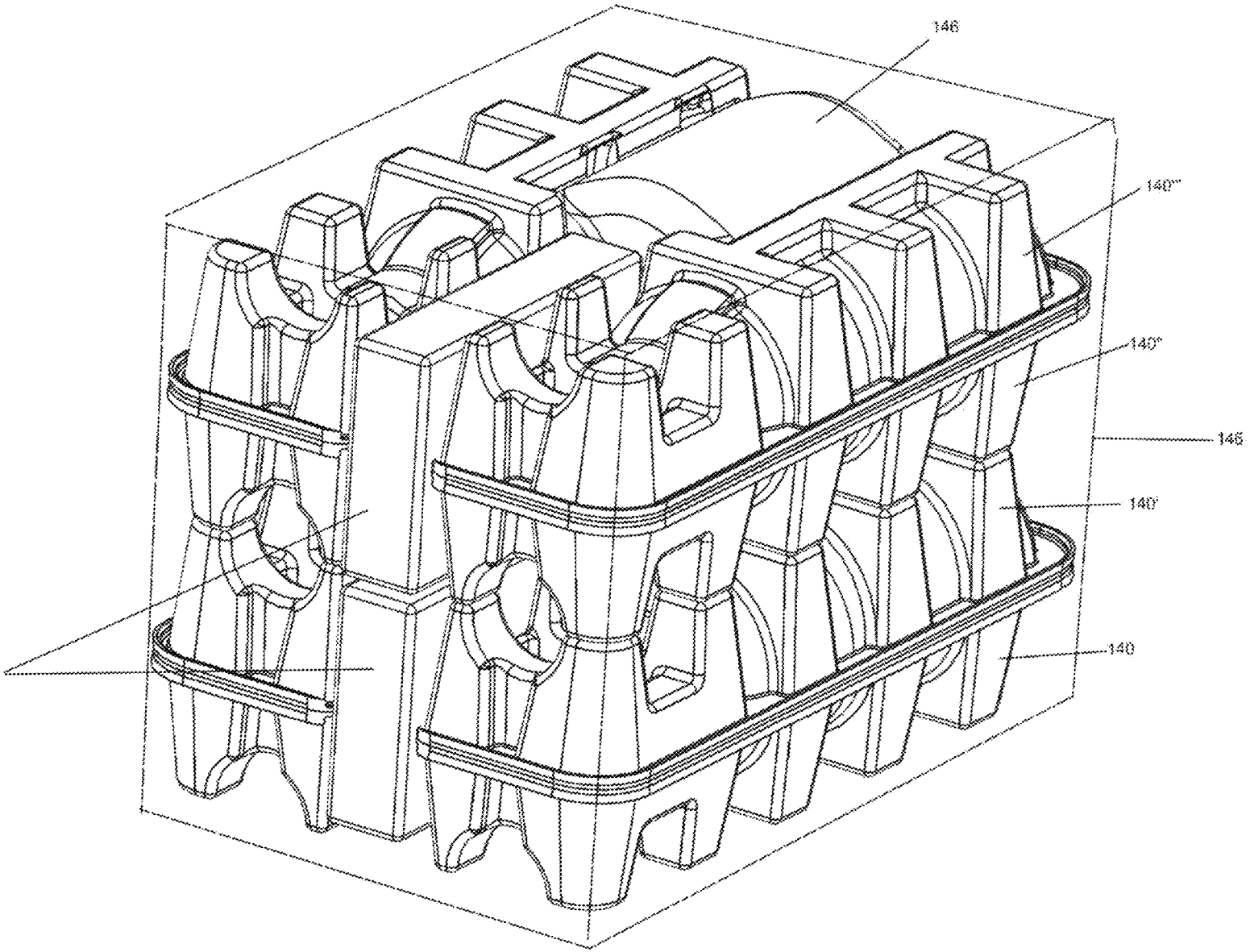
FIG. 22 is a perspective view of use of plural ones of the SHIPPING PROTECTOR of FIG. 18 in shipping multiple bottles.

FIG. 22 is a perspective view of use of plural ones of the SHIPPING PROTECTOR of FIG. 18 in shipping multiple bottles, four bottles in the illustrated example, wherein a lowest protector 140 is positioned face up in the bottom of a box 146 (illustrated in phantom), with a cooling element placed below the protector in the area of the cooling windows 142, 144, thereby providing receiving bays for two bottles. The bottles are placed in the protector 140, and a second protector 140' is inverted on top of the lowest protector. A flexible cooling element (not visible in FIG. 22) may be placed on top of the protector 140' in the area the cooling windows so as to contact with the bottles in the lower trays. A third protector 140" is positioned face up on top of the protector 140', and two further bottles are placed in the respective receiving bays of the protector 140". A fourth shipping protector 140" is placed face down on top of the protector 140', and a flexible cooling element 146 is positioned on top of the protector 140" in the area of the cooling windows 142, 144 on the protector 140". Cooling elements 138, 138' may be placed in the respective receiving bays 128 for additional cooling, as required by the particular conditions and bottle contents.

Thus, in accordance with the various embodiments illustrated, protected shipping of containers such as wine bottles can be implemented in a variety of bottle counts, in multiples of one, two or three bottles, for example.

In accordance with the invention, improved shipping protectors and methods are provided to enable efficient packing and shipping of containers, such as wine bottles or the like, allowing optional use of cooling elements for shipments in heat hold conditions, allowing the same packaging supplies to be employed whether cooling is required or not.

While a plural embodiments of the technology have been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A beverage container packing tray, comprising:

a beverage container receiver bay region for receiving one or more bottles in a lie flat configuration;

a first coolant receiving bay defined at a first peripheral edge of said beverage container packing tray external to an interior of the beverage container packing tray for defining a first space to receive a first coolant element within the first coolant receiving bay; and the first coolant element positioned within said first coolant receiving bay.

2. The beverage container packing tray according to claim 1, further comprising a second coolant receiving bay defined at a second peripheral edge of said beverage container packing tray external to the interior of the beverage container packing tray for defining a second space to receive a second coolant element within the second coolant receiving bay; and the second coolant element positioned within said second coolant receiving bay.

3. The beverage container packing tray according to claim 2, wherein the second coolant receiving bay has a bay width dimension that is approximately equal to one third of the second width side width dimension.

4. The beverage container packing tray according to claim 2, wherein the second coolant receiving bay has a bay width dimension of approximately 4 inches.

5. The beverage container packing tray according to claim 1, wherein said first coolant receiving bay is open at a top and bottom of the first coolant receiving bay such that the first coolant element can be inserted within the first coolant receiving bay from above.

6. The beverage container packing tray according to claim 1, wherein said beverage container receiver bay region comprises molded fiber.

7. The beverage container packing tray according to claim 6, wherein said beverage container receiver pack bay region comprises a moisture resistance feature.

8. The beverage container packing tray according to claim 1, wherein the bottles comprise wine bottles.

9. The beverage container packing tray according to claim 1, further comprising a hingeable portion for enabling folding of the beverage container packing tray against itself.

10. The beverage container packing tray according to claim 9, wherein said first coolant receiving bay is defined along a longitudinal line aligned with said hingeable portion.

11. The beverage container packing tray according to claim 1, further comprising a cooling window defined in the beverage container packing tray for enabling direct contact between a cooling element and a beverage container positioned in the beverage container packing tray.

12. The beverage container packing tray according to claim 1, further comprising plural cooling windows defined in the beverage container packing tray for enabling direct contact between a cooling element and a beverage container positioned in the beverage container packing tray.

13. The beverage container packing tray according to claim 1, wherein the first coolant receiving bay has a bay width dimension that is approximately equal to one third of the first width side width dimension.

14. The beverage container packing tray according to claim 1, the first coolant receiving bay has a bay width dimension that is approximately 4 inches.

15. A beverage container packing tray, comprising:

a beverage container receiver pack for receiving one or more bottles in a lie flat configuration; and a first coolant receiving bay defined at a first peripheral edge of said beverage container packing tray external to an interior of the beverage container packing tray for defining a first space to receive a first coolant element within the first coolant receiving bay, wherein said beverage container packing tray has a peripheral edge lip along edges of said packing tray, but not along a face of the first coolant receiving bay.

16. A beverage container packing tray, comprising:

a beverage container receiver pack for receiving one or more bottles in a lie flat configuration; and a first coolant receiving bay defined at a first peripheral edge of said beverage container packing tray external to an interior of the beverage container packing tray for defining a first space to receive a first coolant element therewithin, further comprising a second coolant receiving bay defined at a second peripheral edge of said beverage container packing tray external to the interior of the beverage container packing tray for defining a second space to receive a second coolant element within the second coolant receiving bay, wherein said beverage container packing tray has a peripheral edge lip along edges of said packing tray, but not along a face of the second coolant receiving bay.

17. A beverage container packing tray, comprising:

a beverage container receiver pack for receiving one or more bottles in a lie flat configuration;

a first coolant receiving bay defined at a first peripheral edge of said beverage container packing tray external to an interior of the beverage container packing tray for defining a first space to receive a first coolant element within the first coolant receiving bay; and the first coolant element positioned within the first coolant receiving bay, wherein the beverage container receiver pack comprises one or more bottle receiving bays, and said first coolant receiving bay is approximately the width of one of said bottle receiving bays.

18. The beverage container packing tray according to claim 17, further comprising a second coolant receiving bay defined at a second peripheral edge of said beverage container packing tray external to the interior of the beverage container packing tray for defining a second space to receive a second coolant element within the second coolant receiving bay; and the second coolant element positioned within the second coolant receiving bay, said second coolant receiving bay having a second width dimension and said second width dimension is approximately the width of one of said bottle receiving bays.

* * * * *